United States Patent [19]

Polan

[11] Patent Number: 4,732,216

[45] Date of Patent: Mar. 22, 1988

[54] QUICK RELEASE MECHANISM FOR SPRINKLER HEAD

[75] Inventor: George S. Polan, North Wales, Pa.

[73] Assignee: Central Sprinkler Corporation, Lansdale, Pa.

[21] Appl. No.: 854,369

[22] Filed: Apr. 21, 1986

[51] Int. Cl.[4] ..... A62C 37/08

[52] U.S. Cl. ..... 169/38

[58] Field of Search ..... 169/37–41, 169/90; 137/70, 78.1, 72

[56] References Cited

U.S. PATENT DOCUMENTS

| | | | |
|---|---|---|---|
| 2,287,988 | 6/1942 | Griffith | 169/38 |
| 2,664,956 | 1/1954 | Barz | 169/38 |
| 3,336,984 | 8/1967 | Macartney | 169/38 |
| 3,561,537 | 2/1971 | Dix | 169/38 |
| 4,343,364 | 8/1982 | Glinecke | 169/38 |
| 4,376,465 | 3/1983 | Simons et al. | 169/39 |
| 4,440,234 | 4/1984 | Shea | 169/39 |
| 4,618,001 | 10/1986 | Hoening | 169/38 |

*Primary Examiner*—Sherman D. Basinger
*Assistant Examiner*—Lynn M. Fiorito
*Attorney, Agent, or Firm*—Seidel, Gonda, Goldhammer & Abbott

[57] ABSTRACT

Quick release mechanism for a sprinkler head includes a latch assembly for holding the valve in sealing engagement over an outlet orifice. The assembly comprises a generally U-shaped ejection plate pivotally mounted between the sprinkler head frame and valve in canted relation to the center line of the sprinkler head, and a thermal responsive element mounted between the sprinkler frame and valve-holding end of the ejection plate. The thermal responsive element contains a pellet of fusible alloy and a ceramic bearing slug and glass ball to hold the element between the ejection plate and sprinkler head frame in order to optimize the response time. The whole pellet housing with its heat fins is effectively insulated from the rest of the latch assembly by the glass ball and an insulator sleeve at its extremities. When the alloy melts, the ceramic slug and glass ball drop downwardly, destabilizing the latch assembly and thereby permitting fluid pressure to blow the seal at the outlet orifice. The orifice seal cap, ejection plate and thermal responsive element drop away so that pressurized fluid can pass freely through the orifice.

12 Claims, 8 Drawing Figures

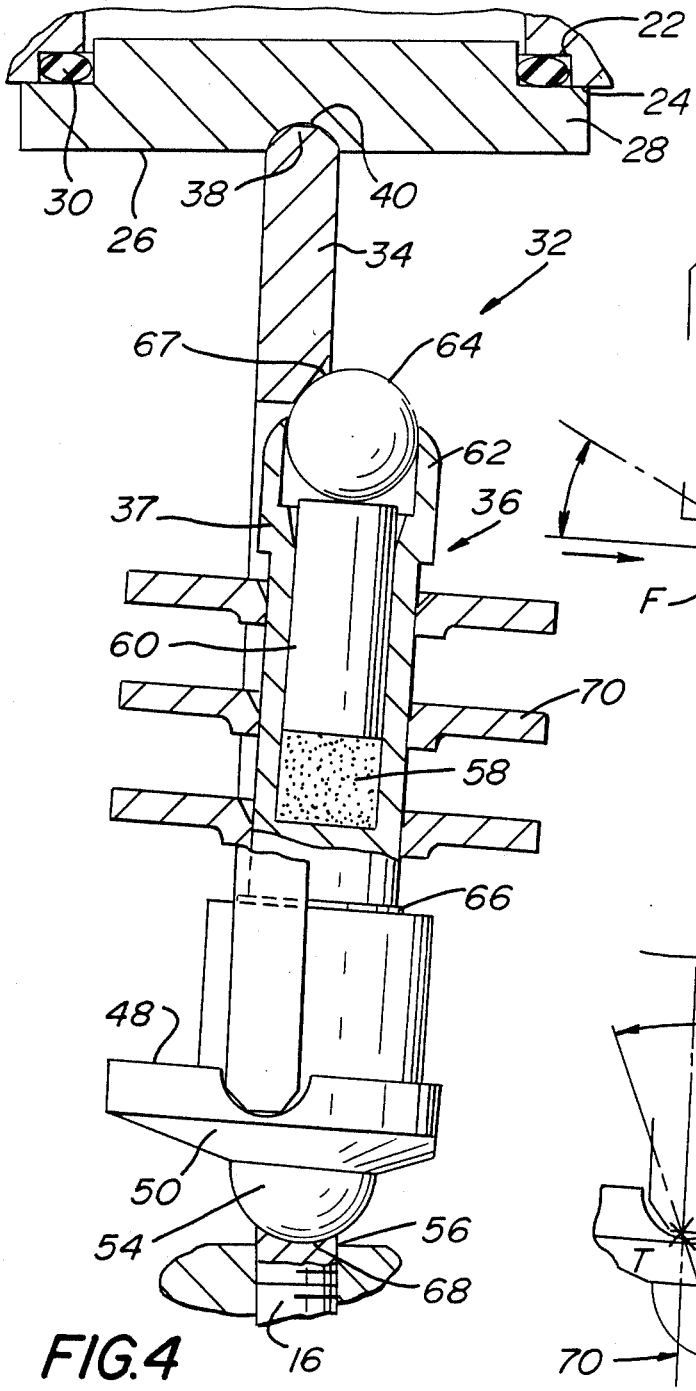
FIG.4
FIG.6
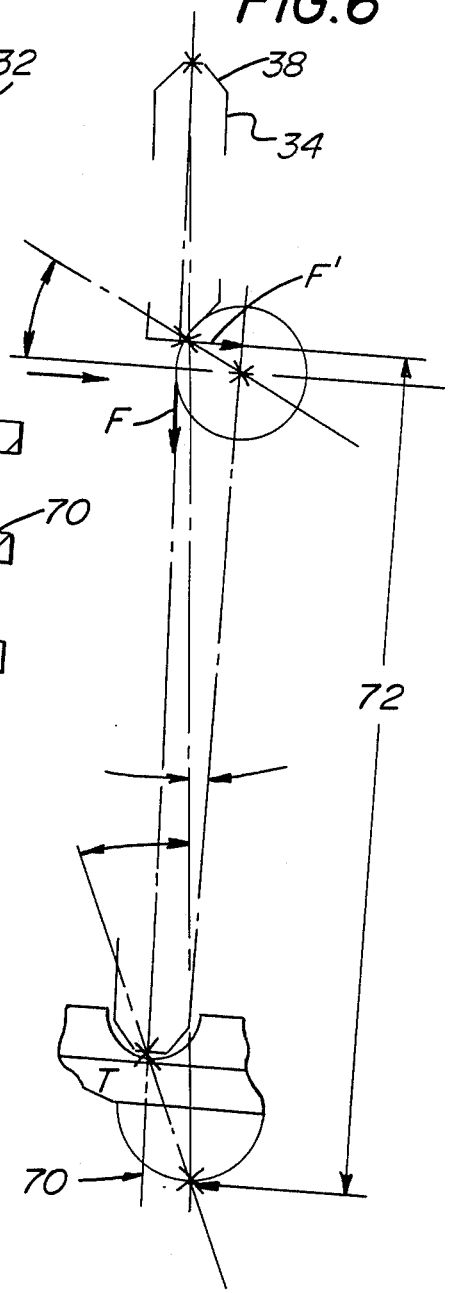

QUICK RELEASE MECHANISM FOR SPRINKLER HEAD

BACKGROUND OF THE INVENTION

The invention is directed to a quick release mechanism for a sprinkler head in which a thermal responsive element, such as those which include a fusible alloy, is used as the triggering element in a valve latching arrangement. The sprinkler head is connected to a conduit which provides pressurized fluid, such as water, for extinguishing a fire.

It is known to provide a sprinkler head having a valve member retained in a closed position by latch means. It is also known to provide a temperature responsive means for releasing such a latch means as shown, for example, in U.S. Pat. No. 4,508,175.

It is desirable in such a system to use elements of low mass and high thermal conductivity in order to reduce reaction time. A countervailing factor in providing elements having such characteristics is the fluid system pressure which normally is of such magnitude as to preclude use of structures which are small and thin walled.

The present invention is directed to a solution of the problem of how to reduce compressive forces on a sprinkler head latch system whereby the critical component parts of the system may be smaller and thinner than prior art arrangements so that reaction time can be reduced substantially.

The invention is also directed to a solution of the problem of how to eliminate the "frame arm shadow" effect which is inherently present on the majority of the conventional style sprinkler frames. This noted "shadow" acts as a diffuser or deflector to the preheated air or gases which deflect away from the heat sensitive activation member of a given latch mechanism. To overcome this noted condition, the present invention incorporates several very thin heat fins which protrude on either side of the sprinkler frame arm, well beyond the "shadow" zone, and conduct heat to the pellet housing.

SUMMARY OF THE INVENTION

An automatic sprinkler head is provided in which discharge of water is controlled by a quick release mechanism in the form of a latch-operated valve. The latch means is constructed to retain the seal cap valve in closed position during normal environmental conditions and comprises a structural element, one end of which is pivotally mounted on the seal cap and an opposite end of which is pivotally mounted on the end collar in lateral off-setting relation with respect to the pivotal axis of the end collar and a thermally responsive element interposed between the end collar and the structural element such that forces acting on the structural element and thermally responsive element produce counteracting balanced moments about the end collar. The thermally responsive element of the structure includes means such for example, as a fusible alloy, which upon melting acts to release said thermal responsive and structural elements from engagement thereby to cause the latch means to release the seal cap from sealing engagement with the outlet orifice of the sprinkler head. The fusible alloy acts as the triggering mechanism for destabilizing the latching structure to permit rapid release of the latch and opening of the valve when the system is subjected to a predetermined high temperature. The latch means is uniquely constructed for reducing compressive loads on the temperature-responsive portion of the system which forces derive from high fluid pressure or as a result of water hammer.

For the purpose of illustrating the invention, there is shown in the drawings a form which is presently preferred; it being understood, however, that this invention is not limited to the precise arrangements and instrumentalities shown.

FIG. 4 is an enlarged, partial sectional view taken along the line 4—4 of FIG. 2 showing the sprinkler in an inactive state.

FIG. 6 is a force diagram of the latching structure under operational loading.

DETAILED DESCRIPTION

Figure 1:
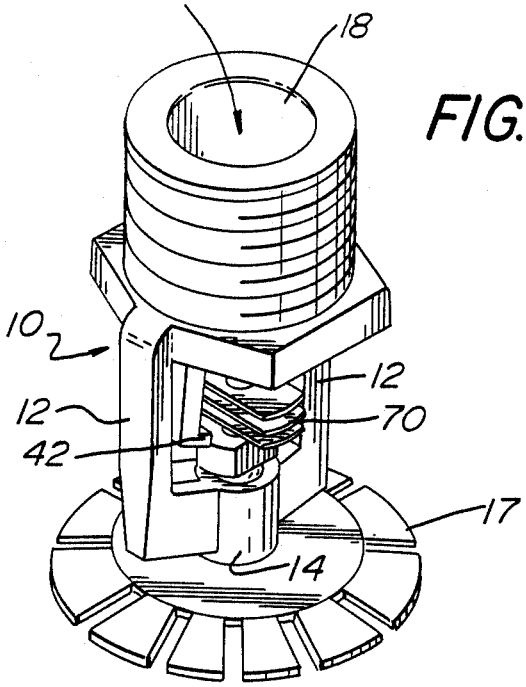
FIG. 1 is a perspective view showing a sprinkler head embodying a preferred form of the present invention.
Figure 2:
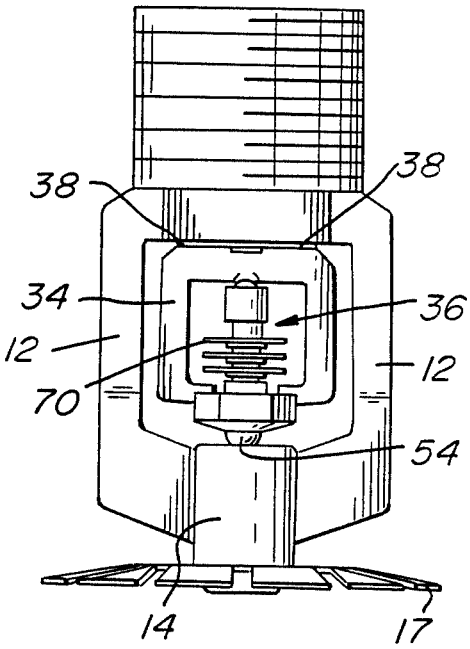
FIG. 2 is a front elevational view of the sprinkler shown in FIG. 1.
Figure 2A:
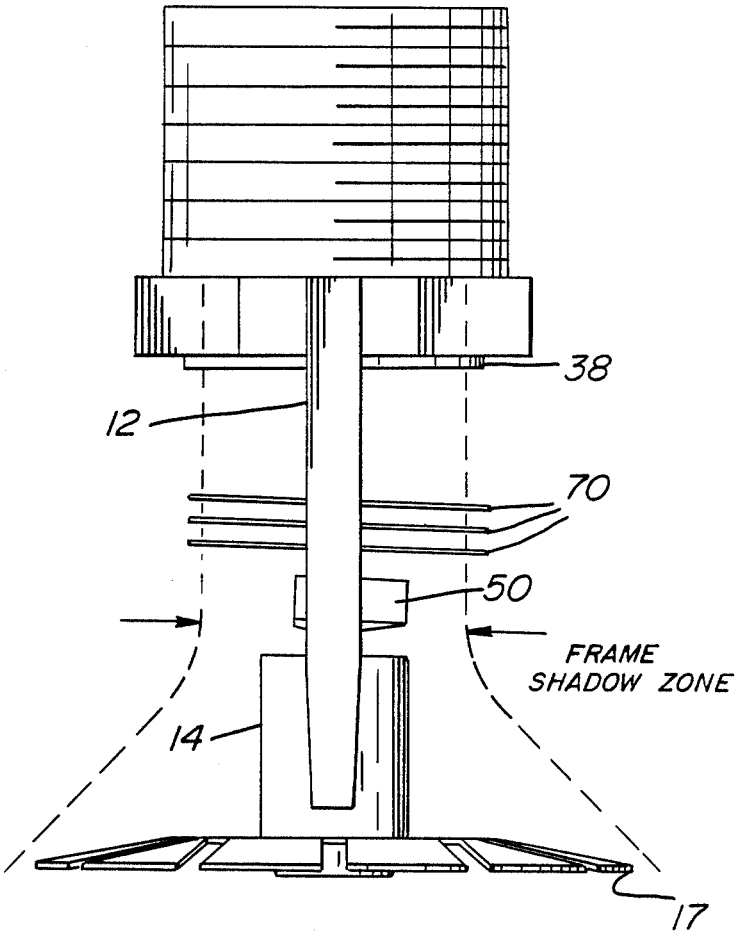
FIG. 2A is a side view showing the frame arm shadow zone and heat fin protrusion.
Figure 3:
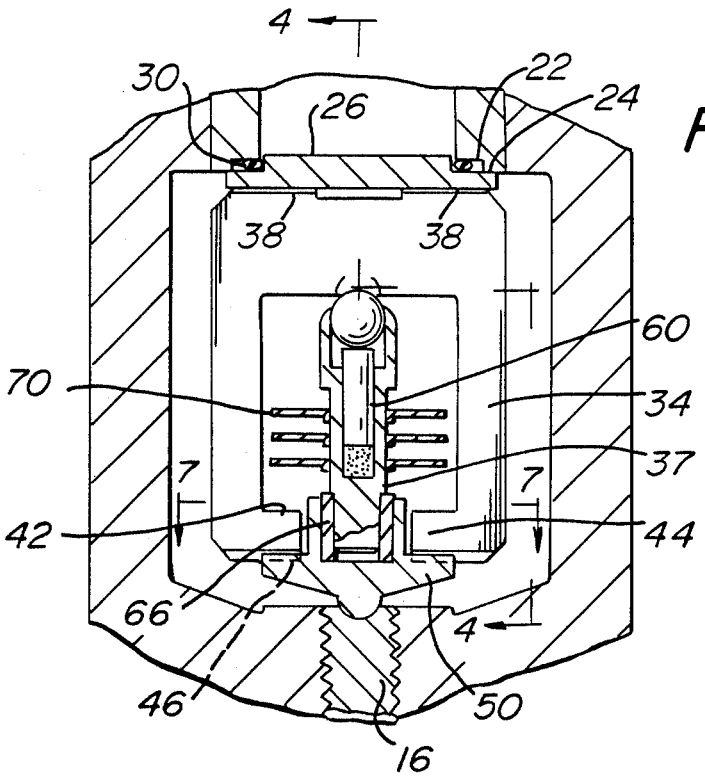
FIG. 3 is a sectional view taken along the line 3—3 in FIG. 2.
Figure 7:
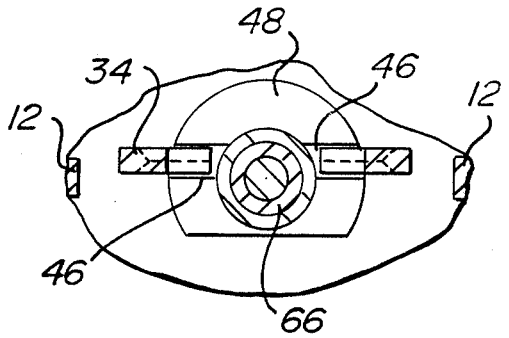
FIG. 7 is a sectional view taken along the line 7—7 of FIG. 3.

Referring to the drawing in detail, wherein like numerals indicate like elements there is shown in FIG. 1 an embodiment of the quick release mechanism of the present invention incorporated in a sprinkler head designated generally as 10. The sprinkler head body includes a pair of arms 12 integral with a collar 14 provided with a threaded passage which retains a set screw 16 (FIG. 3) for adjusting preload. Attached to the set screw as an integral part thereof is the deflector plate 17. The sprinkler head body is provided with a flow passage 18 which is adapted to be threadably engaged to a pressurized fluid conduit (not shown) as is well known in the art. Pressurized fluid, typically water, enters the flow passage 18 as indicated by the arrow in FIG. 1. The flow passage 18 terminates in a valve seat comprising a pair of annular shoulders 22, 24 as seen in FIGS. 3 and 4. A seal cap 26 having a generally annular configuration closes passageway 18. The seal cap has an annular flange 28 which seats on shoulder 24. An O-ring 30, preferably made of Teflon (Trademark), is captured under compression between the seal cap flange 28 and annular shoulder 22 to provide the valve seal. As best seen in FIG. 4, the O-ring is maintained under resilient compression to insure quick release of the valve seal upon dislocation of the latch means as hereinafter described.

The seal cap is held in closed position over passageway 18 by means of the latch assembly 32 (FIG. 4). The latch assembly comprises an ejection plate 34 and a thermal responsive element 36. The ejection plate 34 is of generally inverted U-shaped configuration and is provided at its closed end with beveled tab portions 38 pivotably mounted in a slot 40 formed in the undersurface of seal cap 26. This construction is shown most clearly in FIGS. 4 and 5. The inturned ends 42 and 44 of the ejection plate are similarly pivotably mounted in channel portions 46 formed in the upper surface 48 of end collar 50. As seen in FIG. 4, end collar 50 is provided with a centrally located hemispherical projection 54 which is seated in a cooperating depression 56 formed in the end of setscrew 16. The compressive preload necessary to maintain the valve or seal cap 26 in place under normally expected operating conditions is obtained by adjusting setscrew 16. This force is transmitted to the seal cap through the latching system comprised of the ejection plate 34 and thermal responsive element 36.

The thermal responsive element 36 comprises a pellet housing 37 of generally tubular shape, one end of which is closed. The housing contains at its closed end a fusible alloy pellet 58 and a ceramic bearing slug 60 resting thereon. Mounted atop the bearing slug and contained within a cylindrical inturned sleeve 62 formed on the pellet housing 37 is a glass ball 64. The closed end of the pellet housing is encased by a heat insulating sleeve or jacket 66. These two elements, the glass ball 64 and sleeve 66, have thermal conductivity coefficients of 5 and 10 respectively, and effectively insulate the pellet housing 37 from the remaining components of the system thereby eliminating any "cold sink" condition which could retard rapid fusing of the alloy pellet 58. The bearing slug 60 further insulates the housing from the ejection plate. The slug also serves a mechanical function. Thus, the slug acts as a compressive member against the pellet 58 such that upon liquefaction of the alloy due to elevated temperatures, the bearing slug forces the alloy to flow upwardly between the housing and slug outer surface and into the inturned ball collar 62. To permit this to occur, the inside diameter of housing 37 and outside diameter of slug 60 are chosen so as to provide the necessary clearance.

As seen in FIG. 4, the thermal responsive element 36 acts to stabilize the overall latching assembly. The thermal responsive element is supported at its lower end in end collar 50. Its upper end is lodged against the ejection plate 34. Thus, ball 64 is seated within a ball retaining arcuate ledge 67 formed in plate 34. Ejection plate 34 and thermal responsive element 36 form a structural support for wedging the seal cap 26 in closed position with very small preload required. The arrangement is such that the torques acting on the pivot point 68 formed at the interface of the hemispherical ball 54 and set screw surface 56 are in equilibrium. The bulk of the force of the water pressure acting on seal cap 26 is transmitted through ejection plate 34. A small portion is transmitted to the ball 64. The torque produced about the pivot point 68 by each of these forces act to neutralize each other under normal conditions. As seen in FIG. 6 the larger force F acting along the plate 34 operates over a smaller moment arm 70 while the smaller force F' acting on the ball 64 operates over a much larger moment arm 72. When the fusible pellet 58 is exposed to a predetermined high temperature the pellet melts. The slug 60 supporting the ball 64 causes the liquefied material to flow through the clearance between the slug and pellet housing with the result that the ball drops away from the plate 34 and clears ledge 67 thereby destabilizing the latching assembly. The result of this action is graphically shown in FIG. 5.

The housing 37, ball 64, fusible alloy pellet 58, ceramic bearing slug 60, and outer insulating jacket 66 form with the ejection plate 34 the quick release latching mechanism of the present invention. As will be noted by reference to FIGS. 5 and 6, the center line of ejection plate 34 and housing 37 are both canted with respect to the center line of the sprinkler head, and are in parallel or near parallel relation to each other. This construction drastically reduces the compressive load acting on the glass ball by a factor of approximately 23:1. This factor can be increased by elongating moment arm 72. This means that for every 23 pounds of static pressure exerted against seal cap 26, the glass ball and hence the fusible pellet, will experience approximately one pound of compressive preload. This unusually high reduction ratio permits use of a very thin walled pellet housing, thereby enhancing the response time of the unit without jeopardizing its strength or structural integrity even under the most severe water hammer or system pressure fluctuations.

To further enhance heat transfer from the surrounding environment, the pellet housing incorporates a plurality of very thin heat fins, e.g. 5 mils thick made of copper, which are positioned to fit inside the single piece ejection plate 34 and to protrude on either side of the sprinkler frame arms 12. This arrangement virtually eliminates frame arm "shadow effect" in which the frame arms act as diffusers or deflectors to the heated airflow. The fin assembly 70 is made by braising or soldering individual fin elements onto the main trunk of the pellet assembly. Also, the pellet housing can be machined as a single unit.

Figure 5:
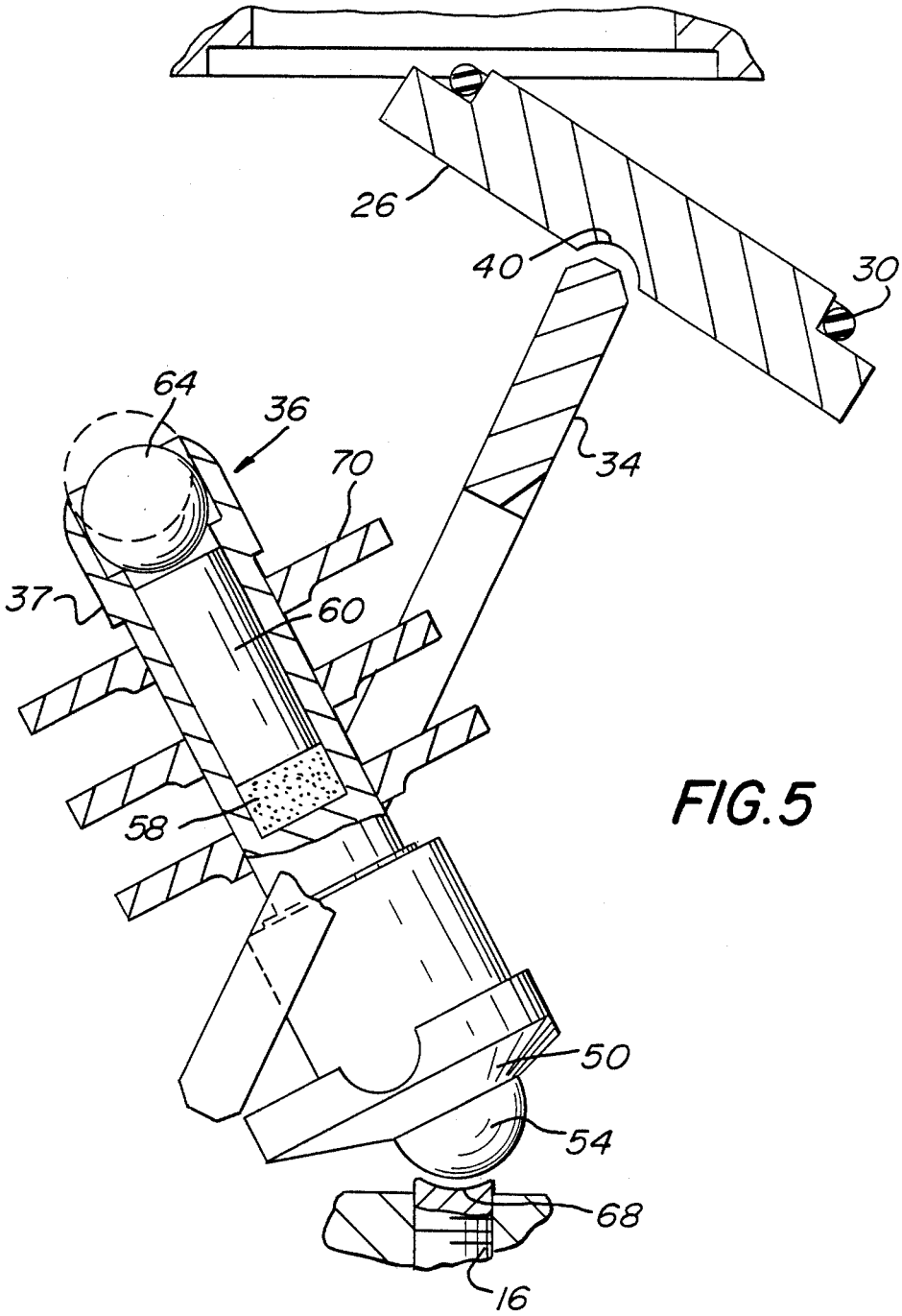
FIG. 5 is a sectional exploded view showing the sprinkler in an activated condition.

FIG. 4 shows the components of the latching mechanism in their normal rest position. FIG. 5 shows the components of the latching system in the activated position. When the ambient temperature reaches a predetermined value the pellet 58 melts, the slug 60 and ball 64 drop removing the pellet housing from its support position against ejection plate 34. Upon release of the ball the pressure in the water main acting on seal cap 26, and through it on ejection plate 34, causes collar 50 to pivot about its pivot point 68 dislodging the ejection plate from the groove 40 in seal cap 26. This action permits the seal cap to fall free of orifice 18 as shown in FIG. 5 while the fire-quenching fluid discharges freely from the orifice 18 onto deflector plate 17.

The present invention may be embodied in other specific forms without departing from the spirit or essential attributes thereof and, accordingly, reference should be made to the appended claims, rather than to the foregoing specification, as indicating the scope of the invention.

I claim:

1. Quick release mechanism for a sprinkler head having an outlet orifice, a pair of arms projecting from body portion adjacent said orifice and a collar integral with said arms containing a preload mechanism, comprising:

a seal cap disposed in sealing engagement with the =sprinkler head over said outlet orifice;

an end collar pivotally mounted on the preload mechanism;

latch means interposed between said end collar and seal cap for holding said seal cap in sealing engagement over said outlet orifice including a structural element on one end of which is pivotally mounted on said seal cap and an opposite end of which is pivotally mounted on said end collar in lateral offsetting relation with respect to the pivot axis of said end collar, and a thermal responsive element one end of which is supported by said end collar and the other end of which supports said structural element such that forces acting on said structural element and thermal responsive element produce counteracting balanced moments about said end collar; and said thermal responsive element including means for releasing said thermal responsive and structural elements from engagement upon exposure to a predetermined temperature thereby to cause said latch means to release said seal cap from sealing engagement with said outlet orifice.

2. Quick release mechanism according to claim 1 wherein said preload mechanism comprises an adjustable set screw.

3. Quick release mechanism according to claim 1 including means insulating said thermal responsive element from said end collar and said structural element.

4. Quick release mechanism according to claim 1 wherein said thermal responsive element comprises a hollow cylinder of high thermal conductivity, an insulative sleeve interposed between one end of said cylinder and said end collar, a glass ball positioned within the opposite end of said cylinder and extending into contact with said structural element and said ball being supported in position within said housing by a fusible pellet such that upon liquifaction of said pellet, said latch is destabilized releasing said seal cap from sealing engagement with said outlet orifice.

5. Quick release mechanism according to claim 1 including a deformable O-ring seal disposed between and in contact with said seal cap and perimeter portions of said outlet orifice for reducing compressive preload on said latch means.

6. Quick release mechanism according to claim 1 wherein said thermal responsive element comprises a housing having a high thermal conductivity coefficient, said housing including a central tubular body portion and one or more thermally conductive fins fused to said body portion and projecting outwardly therefrom past the plane of said sprinkler head arms.

7. Quick release mechanism for a sprinkler head having an outlet orifice, a pair of arms projecting from body portions adjacent said orifice and a collar integral with said arms containing a preload mechanism, comprising:

a seal cap disposed in sealing engagement with the sprinkler head over said outlet orifice;

an end collar pivotally mounted on the preload mechanism;

latch means interposed between said end collar and seal cap for holding said seal cap in sealing engagement over said outlet orifice including a structural element one end of which is pivotally mounted on said seal cap and an opposite end which is pivotally mounted on said end collar in lateral offsetting relation with respect to the pivot axis of said end collar, and a thermal responsive element interposed between and engaged by said end collar and said structual element such that forces acting on said structual element and thermal responsive element produce counteracting balanced moments about said end collar; and said thermal responsive element comprising a hollow cylinder of high thermal conductivity, an insulative sleeve interposed between one end of said cylinder and said end collar, a glass ball positioned within the opposite end of said cylinder and extending into contact with said structural element and said ball being supported in position within said housing by a fusible pellet such that upon liquifaction of said pellet, said latch is destabilized releasing said seal cap from sealing engagement with said outlet orifice.

8. Quick release mechanism according to claim 7 including an insulating bearing slug interposed between said ball and said fusible pellet.

9. Quick release mechanism for a sprinkler head having an outlet orifice, a pair of arms projecting from body portions adjacent said orifice and a collar integral with said arms containing a preload setscrew, comprising:

a seal cap disposed in sealing engagement over said outlet orifice and having a centrally disposed arcuate slot provided on an outwardly presented surface thereof:

an end collar pivotally mounted on said set screw and provided with a cylindrical recess positioned on the pivotal axis of said end collar, and channel portions offset from said pivotal axis;

latch means interposed between said collar and cap for holding said cap in sealing engagement with said outlet orifice including a generally U-shaped ejection plate the closed end thereon being pivotably mounted within the arcuate slot provided in said seal cap and the open ends thereof being pivotably mounted in the channel portions of said end collar, and a tubular housing having a relatively high thermal conductivity coefficient and having an end portion thereof seated within the recess of said end collar and having a fusible alloy pellet disposed therein, and means disposed between said pellet and ejection plate for retaining said housing and ejection plate in stable position between said seal cap and end collar.

10. Quick release mechanism according to claim 9 including a deformable O-ring seal disposed between and in contact with said seal cap and perimeter portions of said outlet orifice for reducing compressive preload on said latch means.

11. Quick release mechanism according to claim 9 wherein said housing includes a central tubular body portion and one or more thermally conductive fins fused to said body portion and projecting outwardly therefrom past the plane of said sprinkler head frame.

12. Quick release mechanism according to claim 9 wherein an insulating jacket surrounds said housing end portion seated within said collar recess and said means disposed between said pellet and ejection plate includes a ball of low thermal conductivity.

* * * * *